US006273627B1

(12) United States Patent
Mittersinker et al.

(10) Patent No.: US 6,273,627 B1
(45) Date of Patent: Aug. 14, 2001

(54) EXPANDABLE WRITING INSTRUMENT

(75) Inventors: Gregor Mittersinker, Warwick; Richard Joseph D'Amico, Cranston; Kevin Lee Browning, Warwick, all of RI (US)

(73) Assignee: A.T.X. International, Inc., Lincoln, RI (US)

( * ) Notice: Subject to any disclaimer, the term of this patent is extended or adjusted under 35 U.S.C. 154(b) by 0 days.

(21) Appl. No.: 09/688,659

(22) Filed: Oct. 16, 2000

(51) Int. Cl.[7] ..... B43K 7/12
(52) U.S. Cl. ..... 401/117; 401/109; 401/99
(58) Field of Search ..... 401/131, 109, 401/112, 115, 117, 99, 95

(56) References Cited

U.S. PATENT DOCUMENTS

| | | | | |
|---|---|---|---|---|
| 370,881 | * | 10/1887 | Michael | 401/117 |
| 544,533 | * | 8/1895 | Harpfer | 401/95 |
| 1,827,619 | * | 10/1931 | Schroeder et al. | 401/95 |
| 2,988,054 | * | 6/1961 | Yates | 401/112 |

* cited by examiner

*Primary Examiner*—David J. Walczak
(74) *Attorney, Agent, or Firm*—Notaro & Michalos P.C.

(57) ABSTRACT

An expandable pen has a pen barrel with an expanding middle section. The pen barrel holds a retractable ball point pen refill cartridge When the pen is expanded, the writing tip of the refill is extended from a retracted position inside the pen barrel to a writing position, while the barrel becomes full length for comfort when writing. The pen may be collapsed for storage, which simultaneously retracts the writing tip inside the pen barrel.

20 Claims, 4 Drawing Sheets

EXPANDABLE WRITING INSTRUMENT

FIELD AND BACKGROUND OF THE INVENTION

The present invention relates generally to the field of writing instruments and in particular to a new and useful mechanism for expanding the length of a writing instrument barrel while extending a writing tip from a retracted position in the barrel to a writing position.

Compact devices of all types are sometimes preferred over full-size versions because they occupy less space. However, some compact devices are not as useful as full-sized versions of the same product for a variety of reasons.

In the case of writing instruments, a small or reduced size pen can be difficult to hold and use for many people, including the elderly, children, the infirm, and people with large fingers. At the same time, a pen or pencil which occupies less space is more easily carried in a pocket or purse.

Sometimes, pens and pencils are sized to fit with other products they are used with, such as a miniature pen provided with a date planner or a golf pencil stored on the steering wheel of a golf cart. These smaller pens and pencils are non-refillable and must be discarded when the ink or lead is used up. While these writing instruments are a compact, convenient size for storing, they are not as comfortably for writing with and suffer the problem that they can be difficult for some persons to use.

Attempts to provide pens having extendable bodies, include a miniaturized ball point pen which is expandable to a more comfortable length for use as disclosed in U.S. Pat. No. 3,174,461. The pen point is always exposed and does not retract within the body of the pen. The body expands by simply sliding two concentric overlapping sections apart. The overlapping sections are frictionally fit to each other. A lower section secures the ball point and ink supply inside the body. The upper section slides inside the lower section and has a tapered end which catches the top of the ink supply to prevent the upper section from being completely separated from the lower section. A cap fits over the upper section and its lower edge stops against the upper edge of the lower section.

U.S. Pat. No. 3,709,620 teaches a ball point pen having a body which is expandable for use as a pointer. The pen body is formed by a series of telescoping tubes which support and contain the ball point and ink supply. The ball point may be extended or retracted from the pen body by a spring-loaded operation button at the top end of the body. The button has a horizontal channel with a spring-loaded slider having a tab which is forced into an opening in the side of the upper tube when the button is depressed to hold the button and keep the pen tip extended. Pressing the top end of a clip mounted outside the upper tube over the tab pushes the tab and slider back within the button, releasing the button from the depressed position. The button spring may then force the button back upward, retracting the pen tip.

While the pen tip may be retracted in this pen, it requires a relatively complex arrangement of springs and sliders and it requires the presence of a clip. The extension/retraction mechanism for the pen tip is not integrated with the expansion for the device either. The pen tip cannot be extended outside the pen point when the tubes are expanded for use as a pointer.

A folding ball point pen is disclosed by U.S. Pat. No. 5,061,104. The pen is hinged near the center of the pen and a recess is provided in the upper section, so that the lower section containing the pen point and ink reservoir may be folded flush into the side of the upper section. The pen point is not retractable.

These prior pens suffer from the problem that either the pen tip is always exposed, which either requires the use of a pen cap, or there is the risk of accidental marks. The pen is not replaceable; once the ink is used up, the device must simply be thrown away and replaced in its entirety.

SUMMARY OF THE INVENTION

It is an object of the present invention to provide a writing instrument which can be easily expanded from a compact storage size to a longer writing size.

It is a further object of the invention to provide a writing instrument which includes a mechanism for extending and retracting a writing tip when the writing instrument is expanded from a compact storage size to a full-size position for use.

Accordingly, an expandable pen is provided with a pen barrel having an expanding middle section. The pen barrel holds a retractable ball point pen refill cartridge. When the pen is expanded, the writing tip of the refill is extended from a retracted position inside the pen barrel to a writing position, while the barrel becomes full length for comfort when writing.

The pen has a front section secured to a pen body with a cap which slidably fits over the pen body and mates with the front section when the pen is in the compacted state. The refill cartridge fits within a chamber defined by the front section, pen body and cap and is held at a pen point end by a coil spring. A cam at the other end causes the refill cartridge to be extended for use when the cap is slid away from the front section. The cam rotates downwardly on a hinge pin into contact with the top of the refill cartridge, thereby forcing the cartridge downward and the coil spring to compress. The writing tip on the cartridge is thus extended for use, while the length of the pen is expanded for more comfortable writing.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which a preferred embodiment of the invention is illustrated.

DESCRIPTION OF THE PREFERRED EMBODIMENTS

Figure 1:
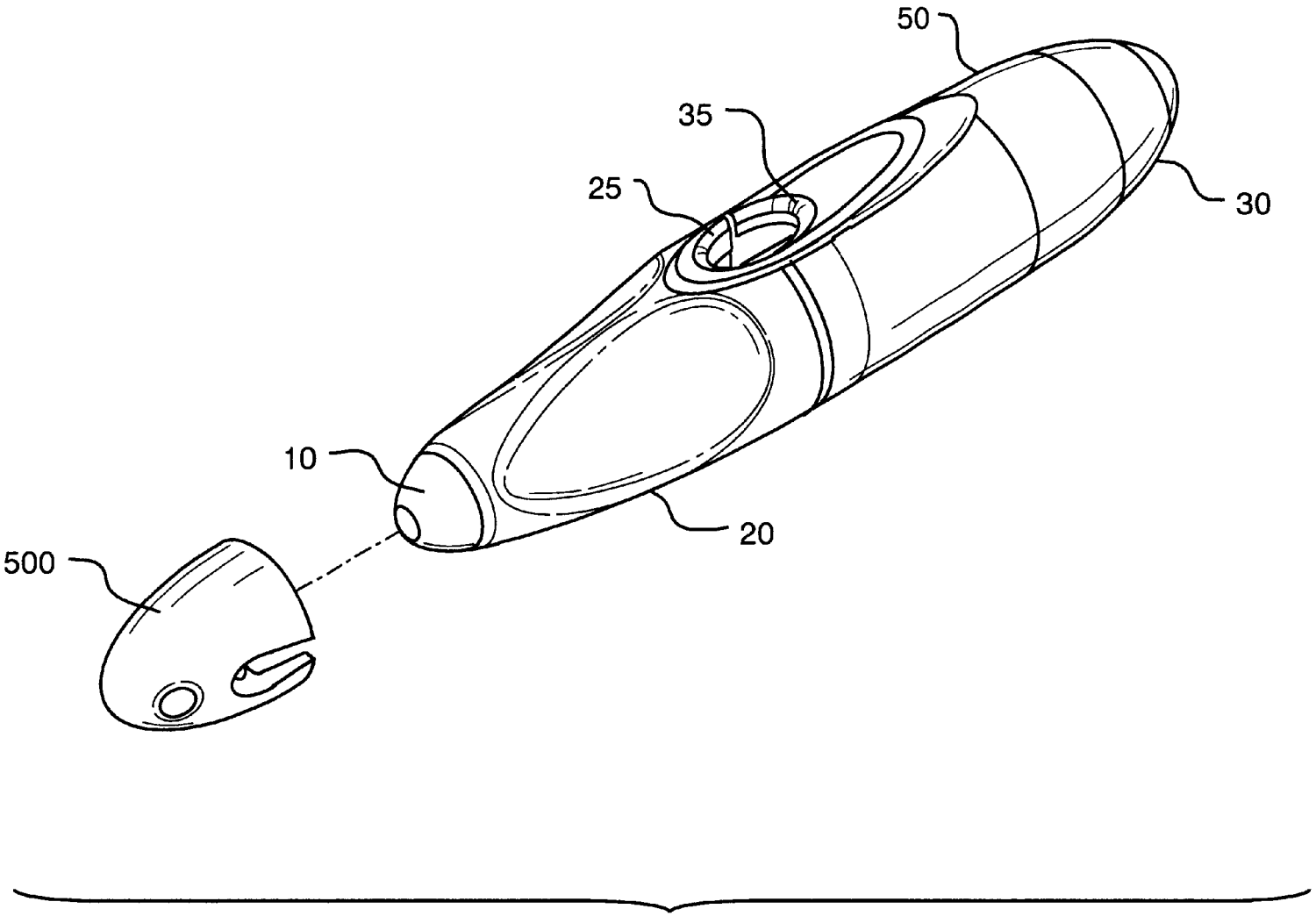
FIG. 1 is a front, side, tip end perspective view of a writing instrument according to the invention in a storage position.

Referring now to the drawings, in which like reference numerals are used to refer to the same or similar elements, FIG. 1 shows a writing instrument according to the invention in the form of an expandable ball point pen 50. As seen in FIG. 1, the pen 50 is in a collapsed, storage position. The pen 50 may optionally have a key fob 500 which frictionally fits over a pen point 10 connected to the front section 20 of the pen 50. The key fob 500 may be used to connect the pen 50 to a keychain or lanyard (not shown) for carrying the pen 50.

In the storage position, the front section 20 mates with a cap 30 to form a compact, generally cylindrical pen 50. A pair of indentations 25, 35 are provided in the side of the pen in adjacent portions of the front section 20 and cap 30, respectively. The indentations 25, 35 may be used to grip the pen 50 in order to expand it to the position shown in FIG. 2.

Figure 2:
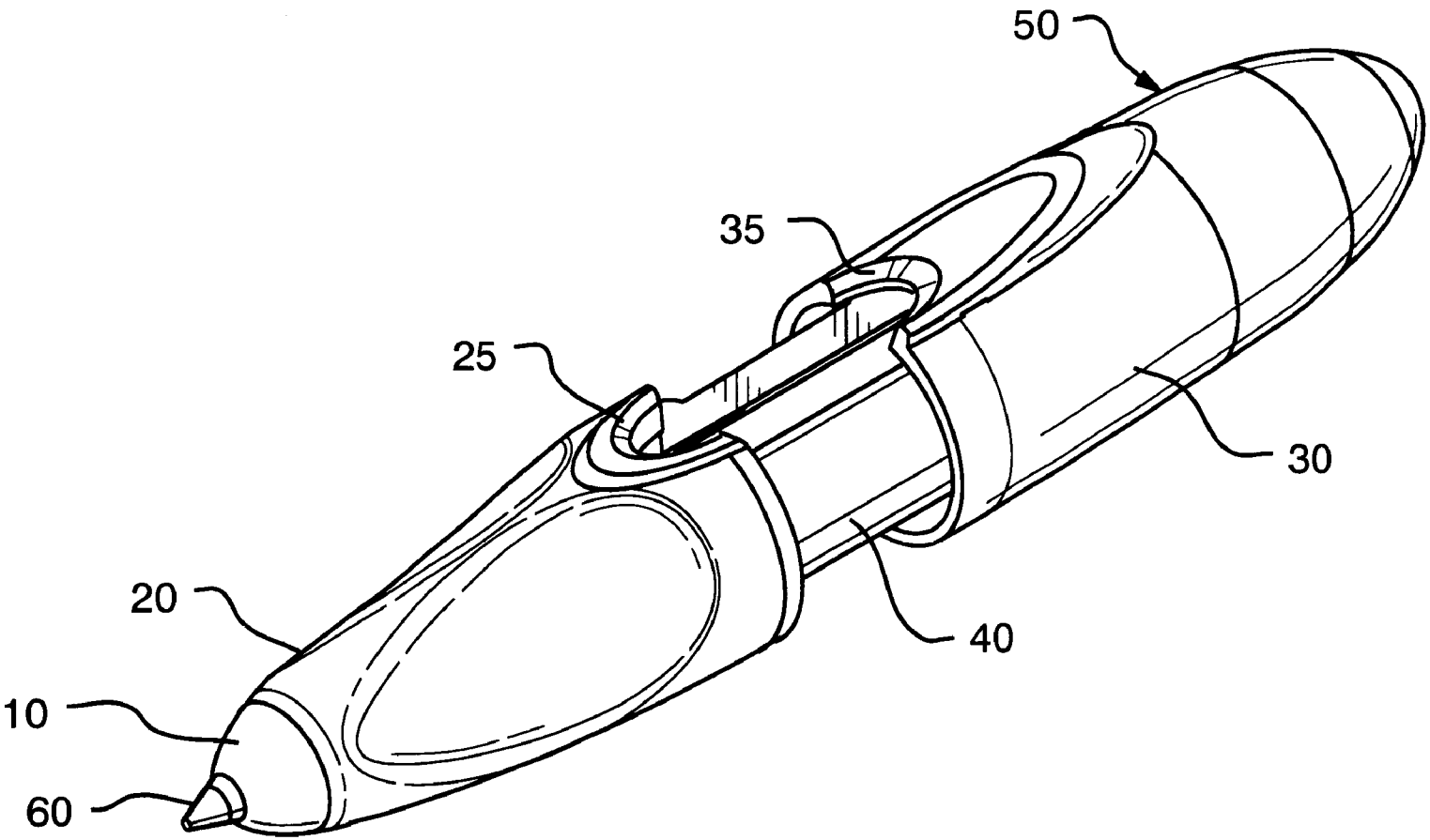
FIG. 2 is a front, side, tip end perspective view of the writing instrument of FIG. 1 expanded for use.

As seen in FIG. 2, when the pen 50 is in the expanded position, the writing tip 60 is extended for use through the pen point 10 at the bottom end of front section 20. A pen body 40 connected to the front section 20 is exposed by sliding the cap 30 away from the front section 20. The cap 30 is slidably mounted on the pen body 40 so that the cap 30 can move between the closed and expanded positions without completely separating from the pen body 40.

Figure 3:
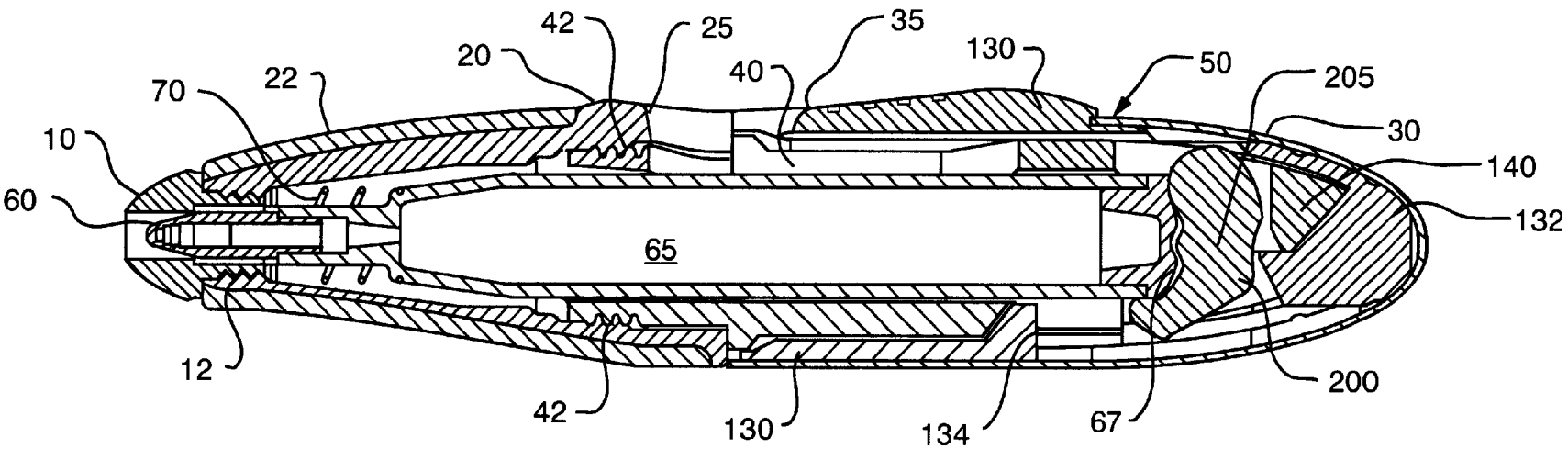
FIG. 3 is a sectional side elevational view of the writing instrument of FIG. 1 in the storage position.
Figure 4:
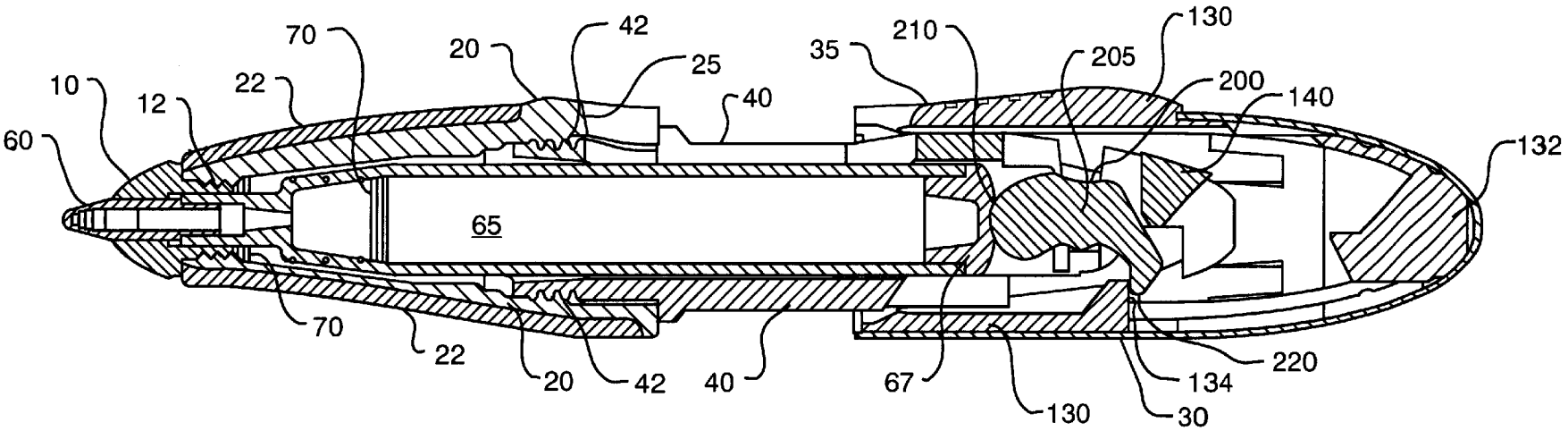
FIG. 4 is a sectional side elevational view of the writing instrument of FIG. 1 expanded for use.

FIGS. 3 and 4 show the internal connections of the pen 50 components and cam mechanism used to extend and retract refill cartridge 65.

The pen 50 has front section 20 secured to pen body 40 at one end and a pen point 10 at the other end, both by threaded connections 42, 12, respectively. Optionally, a grip covering 22 lines the outside of the front section 20. The grip covering 22 can be a rubber or other similar material which provides good tactile properties when the pen 50 is used.

The cap 30 covers a cap liner 130, which is slidably mounted on the pen body 40. The cap 30 and cap liner 130 contact the front section 20 to cover the pen body 40 when the pen 50 is in the storage position.

The front section 20, pen body 40, pen point 10, and cap liner 130 and cap 30 define a chamber for holding the refill cartridge 65. A coil spring 70 supports the bottom end of the refill cartridge 65 against the upper edge of the pen point 10 inside the front section 20. The spring 70 tends to force the refill cartridge 65 away from the pen point 10 and keep it in a retracted position.

A cam 200 is mounted to the pen body 40 on a hinge pin 205 inside the chamber. The cam 200 is positioned at the back end 67 of the refill cartridge 65 inside the cap liner 130. The cam 200 rotates on the hinge pin 205 to extend the refill cartridge 65 to a writing position when the pen 50 is expanded by sliding the cap 30 and front section 20 apart.

The cam 200 is irregularly shaped and has a rounded surface 210 at one end and a tooth 220 at the other end. A ledge 134 on the cap liner 130 contacts the tooth 220 to force the rounded surface 210 of cam 200 to rotate downwardly when the pen 50 is expanded. The rounded surface 210 of the cam 200 in turn contacts the back end 67 of the refill cartridge 65. The cam 200 forces the cartridge toward the pen point 10 and compresses the coil spring 70 between the front of the refill cartridge 65 and the pen point 10. When the pen 50 is fully extended, the rounded surface 210 of cam 200 rests in a depression in the back end 67 of the refill cartridge 65. The cam 200 is thus held in a stable position where it is prevented from rotating back on its own.

To retract the refill cartridge 65 and collapse the pen 50, the front section 20 and cap 30 are forced back together to dislodge the cam 200 from the depression in the back end 67 of the cartridge 65. A slide stop 140 on the pen body 40 mates with a corresponding stop 132 formed in the cap liner 130 to keep the cap 30 from being forced too far against front section 20 when the pen is closed to the storage position. The slide stop 140 is also shaped to help ensure the cam 200 rotates back to the closed position.

The refill cartridge 65 can be replaced by unscrewing threaded connection 42 between the front section 20 and pen body 40, removing the spent cartridge 65 and replacing it with a new one. The front section 20 and pen body 40 can be rejoined and the pen 50 used as described above.

Using the pen 50, a compact writing instrument can be quickly expanded to a larger writing position while simultaneously extending the pen tip for use.

In the event that a disposable version of the pen 50 is desired, the front section 20 and pen body 40 could be fused together as a single piece, rather than connected by a threaded connection. Similarly, the pen point 10 could be formed integral with the front section 20, and the cap liner 130 and cap 30 could be formed as a single piece instead of as separate components.

The use of the term refill cartridge herein is intended to mean any self-contained disposable unit which has both a writing material supply and a marking tip for making a visible mark on paper or other material with the writing material. The refill cartridge may be disposable with the pen, or removable from the pen and replaceable.

While a specific embodiment of the invention has been shown and described in detail to illustrate the application of the principles of the invention, it will be understood that the invention may be embodied otherwise without departing from such principles.

What is claimed is:

1. A writing instrument expandable from a compact storage size to a longer, writing size, the writing instrument comprising:

a pen body having a front section with a pen point at one end of the pen body and a second end;

a cap slidably mounted on the second end of the pen body, the pen body, and cap forming a hollow chamber;

a refill cartridge held longitudinally movable within the hollow chamber, the cartridge having a writing tip at one cartridge end;

a spring operatively connected between the writing tip and the pen point;

cam means for longitudinally moving the refill cartridge toward the pen point within the hollow chamber against the spring to extend the writing tip through the pen point to a marking position when the cap is slid away from the pen point on the pen body to an expanded position.

2. A writing instrument according to claim 1, further comprising stabilizing means for holding the pen body and cap in the expanded position.

3. A writing instrument according to claim 2, wherein the cam means comprises a cam mounted inside the chamber for contacting the cartridge end opposite the writing tip and moving means for rotating the cam into contact with the cartridge when the cap is moved to the expanded position.

4. A writing instrument according to claim 3, wherein the cam is mounted on the pen body.

5. A writing instrument according to claim 4, wherein the moving means comprises a tooth on the cam, and a ledge on the cap, the ledge contacting the tooth and rotating the cam to move the refill cartridge toward the pen point.

6. A writing instrument according to claim 5, wherein the stabilizing means comprises a rounded end on the cam for engaging a depression in the end of the refill cartridge opposite the writing tip when the cap is fully extended on the pen body.

7. A writing instrument according to claim 6, wherein the front section is separable from the pen body.

8. A writing instrument according to claim 6, wherein the refill cartridge is replaceable.

9. A writing instrument according to claim 3, wherein the stabilizing means comprises a rounded end on the cam engaging a depression in the end of the refill cartridge opposite the writing tip when the cap is fully extended on the pen body.

10. A writing instrument according to claim 9, wherein the front section is separable from the pen body.

11. A writing instrument according to claim 9, wherein the refill cartridge is replaceable.

12. A writing instrument according to claim 1, wherein the cam means comprises a cam mounted inside the chamber for contacting the cartridge end opposite the writing tip and moving means for rotating the cam into contact with the cartridge when the cap is moved to the expanded position.

13. A writing instrument according to claim 12, wherein the cam is mounted on the pen body.

14. A writing instrument according to claim 13, wherein the moving means comprises a tooth on the cam, and a ledge on the cap, the ledge contacting the tooth and rotating the cam to move the refill cartridge toward the pen point.

15. A writing instrument according to claim 14, wherein the front section is separable from the pen body.

16. A writing instrument according to claim 14, wherein the refill cartridge is replaceable.

17. A writing instrument according to claim 1, wherein the front section is separable from the pen body.

18. A writing instrument according to claim 1, wherein the refill cartridge is replaceable.

19. A writing instrument according to claim 1, further comprising a finger grip covering at least a portion of the front section.

20. A writing instrument according to claim 1, further comprising a corresponding pair of indentations formed in the pen body and the cap for separating the cap from the pen body to move the cap to the expanded position.

* * * * *